United States Patent [19]

Leroueil et al.

[11] Patent Number: 4,718,376

[45] Date of Patent: Jan. 12, 1988

[54] BOILER SOOTBLOWING CONTROL SYSTEM

[75] Inventors: Pierre E. Leroueil, Federal Way; R. K. James, Redmond; Gregory K. Brock, Auburn, all of Wash.

[73] Assignee: Weyerhaeuser Company, Tacoma, Wash.

[21] Appl. No.: 15,482

[22] Filed: Feb. 9, 1987

Related U.S. Application Data

[63] Continuation of Ser. No. 793,863, Nov. 1, 1985, abandoned.

[51] Int. Cl.[4] ..... F22B 37/18

[52] U.S. Cl. ..... 122/390; 122/392; 122/379

[58] Field of Search ..... 122/390–392, 122/379; 15/316 A

[56] References Cited

U.S. PATENT DOCUMENTS

| | | | |
|---|---|---|---|
| 2,948,013 | 8/1960 | Bearer, Jr. | 122/392 |
| 4,454,840 | 6/1984 | Dziubakowski | 122/390 |
| 4,475,482 | 10/1984 | Moss et al. | 122/392 |
| 4,488,516 | 12/1984 | Bueters et al. | 122/392 |
| 4,526,135 | 7/1985 | Calhoun et al. | 122/392 |
| 4,527,515 | 7/1985 | Hester, II | 122/392 |
| 4,539,840 | 9/1985 | Klatt et al. | 122/390 |

OTHER PUBLICATIONS

Carter, T. M. and R. Mathieson, *Pulp and Paper Canada,* 82(2): 84–88 (1981).

Hoynalanmaa, Mikko, *Pulp and Paper, 54 (8): 97–99 (1980).*

Mason, Ralph H. et al. Energy Recovery Through Judicious Sootblowing Practices on Recovery Boilers, TAPPI Engineering Conference, Atlanta GA (1977).

Pantsar, Ossi, *Pulp & Paper, 53 (9): 142–145 (1979).*

Pelletier, Homer N. and Thomas J. Gettle, *Pulp and Paper, 53 (2): 127–129 (1979).*

Bailey Controls Company "Sootblowing Optimization Lowers Total Cost of Recovery Boiler Operation" N. D.

Fisher Control N. D.

Measurex (Carter and Mathieson) Reducing Energy Costs and Increasing Throughput With Recovery Boiler Computer Control.

*Primary Examiner*—Henry C. Yuen

[57] ABSTRACT

The invention is a method for controlling sootblowing in a power boiler or chemical recovery boiler. The method comprises assigning the sootblowers into a number of groups. Sootblowers within a group are generally adjacent to each other and cover heat transfer surfaces having similar fouling deposit formation characteristics. Each group will typically have up to 4 sootblowers. Every sootblower is assigned a weight factor which is the percentage of the total number of sootblowing cycles that the sootblower will be operative. Every sootblowing cycle in the boiler begins with the most upstream sootblower group and proceeds progressively through all of the other groups in the direction of the flow of combustion gases until the most downstream sootblower group is reached. By blowing in this manner the dislodged fouling deposits from the upstream heat transfer surfaces are swept in the direction of combustion gases. This sootblowing strategy is designed to maintain the boiler at or near maximum operating efficiency. Reduction in sootblowing steam usage is a secondary consideration, even though in one installation the usage was lowered to about two thirds of that previously needed. On-line instrumentation to determine heat transfer characteristics can be used to modify the default values of the weight factors assigned to the individual sootblowers in order to accommodate on-line changes in operating characteristics. The method is well adapted for use either in a feedback or feed forward control strategy and may also be used with a combination of these techniques.

22 Claims, 7 Drawing Figures

BOILER SOOTBLOWING CONTROL SYSTEM

This is a continuation of application Ser. No. 793,863, filed Nov. 1, 1985, now abandoned.

BACKGROUND OF THE INVENTION

The present invention relates to a method for optimizing sootblowing in steam boilers. It is particularly well adapted for use with chemical recovery boilers used with the kraft pulping process.

The combustion of most fuels results in large quantities of condensible gases and particulates carried up through the boiler with the hot flue gas. In some cases these particulate materials deposit on the boiler tubes where they act as an insulating layer which reduces the thermal efficiency of the boiler. In addition, the ash buildup restricts the gas flow through the tube banks limiting the output of the boiler and sometimes forcing shutdowns. In the case of kraft black liquor combustion, the amount of ash deposited is very large and its removal on a continuing basis is critical to the operation of the boiler.

To minimize the impact of continuous ash buildup in boilers where this occurs, devices using high pressure air or steam called sootblowers are commonly used. The sootblowers are typically in the form of long tubes or conduits which slowly advance into and then withdraw from the boilers and are timed to be blown sequentially over and over again. Steam usage can be very significant, amounting to up to 12% or even more of the total steam generated under certain load conditions. Traditionally, sootblowers have been timed to operate on a fixed cycle regardless of the actual condition of the tubes.

Within the past decade, various attempts have been made to reduce the amount of sootblowing steam. The more sophisticated of these systems attempt to determine the fouling rates for various sections of the boiler. With this information, it is believed that one can make intelligent decisions as to when and where cleaning should be done. These systems are normally computerized and are programmed to perform the calculations required to determine the fouling rate of each portion of the boiler and to select the zones to be cleaned by the sootblowers. This approach may involve the use of instrumentation within the boiler to determine gas side pressure and temperature drops and flow rates through given portions of the tube bank. It may also include instrumentation to measure waterside flow rates and temperature changes. One such system is described by Pantsar, *Pulp & Paper,* 53(9): 142–145 (1979). This system, in addition to using the heat transfer criteria previously noted, also sets a maximum time interval for blowing the various sections of the boiler. Apparently these sections are treated as independent units so that the sections having higher fouling rates are blown more frequently than those with lower rates of deposit buildup.

A paper by Carter and Mathieson, *Pulp and Paper Canada,* 82(2): 84–88 (1981), describes a system similar in many respects to that described by Pantsar. These authors also stress the need to measure heat transfer characteristics in various sections of the boiler. In addition, they note that all of these measurements are dependent upon the firing rate. To compensate for this, all differential temperature or pressure measurements are normalized for boiler load. Minimum time limits are set for each section to avoid overblowing from measurement aberrations. Likewise, maximum time limits are set to ensure that a minimum amount of cleaning is done regardless of the information contributed by the instrumentation. Each section of the boiler is assigned a priority so that the most critical section is chosen if more than one is due for blowing.

U.S. Pat. No. 4,454,840 to Dziubakowski relates to an optimized scheduled timing of sootblowing in which the scheduling is set empirically. The method is based on the use of a relative boiler efficiency measurement. The inventor does recognize an interdependence between various sections or "heat traps" within the boiler. One manifestation of this is seen where two units are scheduled for blowing at approximately the same time. In this case, priority is given to the upstream unit to avoid refouling a clean downstream unit. Other than this situation, units are blown when scheduled without regard to their position in the boiler.

A paper by Pelletier and Gettle, *Pulp & Paper,* 53(2): 127–129 (1979), suggests that the best way of telling when blowing is needed in a section is visual observation. This can be supplemented by operating parameters such as exit gas temperature, steam efficiency, and draft losses. The authors note that rather than continuous blowing, some sections of the boiler needed only to be blown once a shift or once a day.

A paper by Mason et al presented at the TAPPI 1977 Engineering Conference notes that many modern boilers have sootblowers arranged and grouped according to the type of heating surface. This enables one group of sootblowers to be disabled if cleaning is not required in that particular area. They also note that it may be possible to program several blower sequences into a panel to coordinate blower operation with boiler load. The authors also note the cost savings that can be effected in steam usage by building sootblower idle time where this is possible.

A paper by Hoynalanmaa, *Pulp & Paper,* 54(8): 97–99 (1980), describes feed forward disturbance compensation in a sootblowing strategy. This strategy is based on direct measurements of critical parameters and on values calculated from these measurements. All measurements are normalized for flue gas flow. Sootblowing is carried out locally and only when deemed necessary.

At least three computerized sootblowing control system are commercially available at present in the United States. All of these appear to be derivatives of one of the systems just discussed. One system, available from Fisher Control, Marshalltown, Iowa, schedules sootblowing as a function of boiler solids load. Exit gas temperatures from the boiler, economizer, and stack, as well as pressure drops across various sections, are continuously monitored. Sootblowing is done more frequently in areas which tend to foul worst. The boiler is divided into four zones which encompass the economizer, boiler bank, superheater front, and superheater rear and intermediate tube groups. There is no apparent overall integration between these zones except that only one may be blown at a time.

Another computer controlled sootblowing system is available from the Bailey Controls Division of Babcock & Wilcox, a McDermott Company. This appears to be based on the system described in the Dziubakowski patent. Boiler efficiency is calculated on line using a computer based model, and optimum blowing cycle time is calculated for each heat absorbing unit. The model is updated as boiler operating conditions change.

Changes which are due to transducer "noise" are minimized by averaging readings over time. The system employes maximum and minimum cycle times and senses maximum allowable pressure drops across tube groups. A primary consideration appears to be minimizing the amount of sootblowing steam required by the boiler.

A third system is available from Measurex Systems, Inc., Cupertino, Calif. This system has many commonalities with the two just described. The boiler is divided into several sections, each of which has instrumentation indicating the state of fouling. In the event of more than one section being scheduled to blow at a particular time, the software will assign priority. All of the sootblowers in any unit are not necessarily blown each time. Various fixed combinations have been defined which can be chosen depending upon the immediate conditions.

Minimizing sootblowing steam consumption appears to be the primary goal of all the systems just described. The present inventors have taken a different approach and have as primary goals the prevention of boiler plugging and maintenance of boiler efficiency at the highest practical level. Minimization of sootblowing steam is a secondary consideration.

SUMMARY OF THE INVENTION

The present invention is a method for controlling the sootblowers in a steam boiler. It is suitable for use in any type of boiler using any fuel which causes tube fouling due to particulate deposits. For ease of description, the invention will be considered in reference to a kraft pulping process chemical recovery boiler. It will be understood that the choice of this type of boiler is for the purposes of exemplifying the invention and is not intended to be limiting in any manner. As a first step, the sootblowers are assigned into a plurality of groups. The sootblowers within each group are generally adjacent to each other and cover heat transfer surfaces having similar fouling deposit formation characteristics. A given set of boiler tubes may be covered by more than one sootblower group. As one example, the lower part of a superheater tube bank may be covered by one group and the upper part by a second group. Normally, each sootblower group will have more than one sootblower. Most commonly, up to four sootblowers will be assigned to each group. The term "sootblower" is used in the context of either a single sootblower or paired sootblowers which enter the boiler from opposite sides along a common longitudinal axis. Thus, the terms "sootblower" and "sootblower pairs" should be considered synonymous unless otherwise noted. Each sootblower or sootblower pair in every group is assigned a weight factor. Weight factors determine the frequency of operation of the sootblowers as a percentage of the total number of sootblowing cycles. Normally only a portion of the sootblowers in a given group will be blown during any sootblowing cycle. Occasionally, depending on the weight factor assigned to the sootblowers, all or none of the sootblowers assigned to the group may be blown during the sootblowing cycle. A "sootblowing cycle" is intended to mean a given unit of time during which a sequence of sootblowing operations will proceed throughout the entire boiler. It does not infer the blowing of single sootblower.

The assignment of weight factors to the various sootblowers is determined on the basis of past experience and empirical observation relating to the severity of fouling. A weight factor of 100 assigned to a sootblower would indicate that it should be operated every cycle. A weight factor of 50 would indicate that the sootblower should be operated every other cycle. A weight factor of 10 would indicate that, on the average, the sootblower should run only once during every 10 sootblowing cycles. The sootblowers located within a tube group need not, and usually will not, have identical weight factors.

A critical part of the invention is the manner in which sootblowing is carried out. Every cycle begins with the sootblower group at the most upstream portion of the boiler closest to the firebox and proceeds progressively in the direction of flow of combustion gases through the entire tube bank until the final sootblower group at the most downstream portion of the tube bank is blown. Normally, none of the sootblower groups are blown separately or out of turn. In this manner all dislodged fouling deposits ahead of the operating sootblowers are swept toward the boiler stack. By operating in this manner, the boiler is maintained at or near maximum efficiency at all times. An important bonus feature appears to be a significant reduction in sootblowing steam usage.

The sootblowing operation is normally computer controlled. In the preferred form of the invention, instrumentation is provided to monitor heat transfer zones covered by each sootblower group. This instrumentation is of the type that will generally indicate the change in heat transfer characteristics over time due to boiler fouling. Included would be instrumentation that can measure the change in flue gas temperature and pressure drop across a tube bank and the change in enthalpy of water or steam within the tube bank. Instrumentation of this type is fully conventional. Inputs from the instrumentation, in a form which indicates in some manner the change in heat transfer characteristics over time is entered into the computer and converted using a biasing algorithm into a heat transfer biasing factor. This heat transfer biasing factor is used to modify the sootblower weight factors to provide on-line compensation for real time deviations from the normal expected fouling buildup. Information used to calculate the biasing factor is normally averaged over a period of at least half of a nominal sootblowing cycle before being entered into the biasing algorithm. A system of this type is ideal for use in feedback-type control systems.

In another aspect of the invention, instrumentation is provided which generally relates to changes in boiler operating characteristics over time. These could be steam rate, feed water rate, fuel firing rate, or changes in flue gas composition. This information may also be entered into a biasing algorithm to provide an operating characteristic biasing factor. This also may be used to modify the sootblower weight factors to provide on-line compensation for real time changes in boiler operation. It is possible to combine the inputs from the heat transfer sensors and operating sensors to provide a combination of feedback and feed forward-type of control.

It should be emphasized that the system is fully operable without any instrumentation of the type just described. However, such instrumentation is preferred and is extremely useful for optimizing the sootblowing cycle. It is not essential that every sootblower group be monitored with such instrumentation. It is desirable for the operator to be able to override any inputs from dedicated instrumentation.

The computer software includes a spreading algorithm to determine how many and which sootblowers within a sootblower group are to be blown during any given sootblowing cycle. The spreading algorithm is relatively simple and uses estimated present and next blowing cycle fouling load on the heat transfer surfaces covered by a given sootblower group to determine how many and which sootblowers should be blown.

An algorithm to select the sootblowing mode of paired sootblowers has been developed. The sootblowing mode is defined as single blow or double blow. Single blow means that the sootblowers within a pair are blown sequentially. Double blow means that sootblowers within a pair are blown simultaneously. The sootblowing mode is a function of the cycle length as estimated at the beginning of the sootblowing cycle and a function of the projected number of sootblowers remaining to be blown during the ongoing cycle. For a given cycle length, the sootblowing steam usage will increase with an increase in the number of sootblower pairs blown simultaneously.

It is an object of the present invention to provide a method for controlling boiler sootblowers which maintains the boiler at or near maximum efficiency with a minimum usage of sootblowing steam.

It is another object of the present invention to provide a method in which the sootblowing cycle proceeds from upstream to downstream throughout the entire boiler in order to minimize redeposition of dislodged fouling deposits.

It is a further object to provide a sootblowing method in which each individual sootblower is operated only as needed to maintain the heat transfer zone covered by the sootblowers in clean condition.

It is yet another object to assign weight factors to each sootblower to determine its frequency of operation.

It is also an object to provide a means of biasing the weight factors to compensate for deviations from expected real time operations conditions.

These and many other objects will become readily apparent to those skilled in the art upon reading the following detailed description taken in conjunction with the drawings.

DESCRIPTION OF THE PREFERRED EMBODIMENTS

Sootblowers in a kraft chemical recovery boiler are normally installed in opposing pairs at strategic locations throughout the entire tube bank. A sootblower is made of steel tube having a steam nozzle or pair of nozzles at the end. They typically may be from about 2.4–10 m in length and about 100 mm in diameter, and operate on air or steam at about 1000–3000 kPa. Steam is the most commonly used cleaning medium. Each sootblower or sootblower pair is periodically inserted into and then withdrawn from the boiler at a rate of speed generally between about 1 and 3 m/min. Thus, the travel time of a single sootblower is about 3–5 min. Sootblower pairs may be blown simultaneously or sequentially. In sequential mode the blowing time required to blow the sootblower pair is twice as long as in simultaneous mode.

Figure 1:
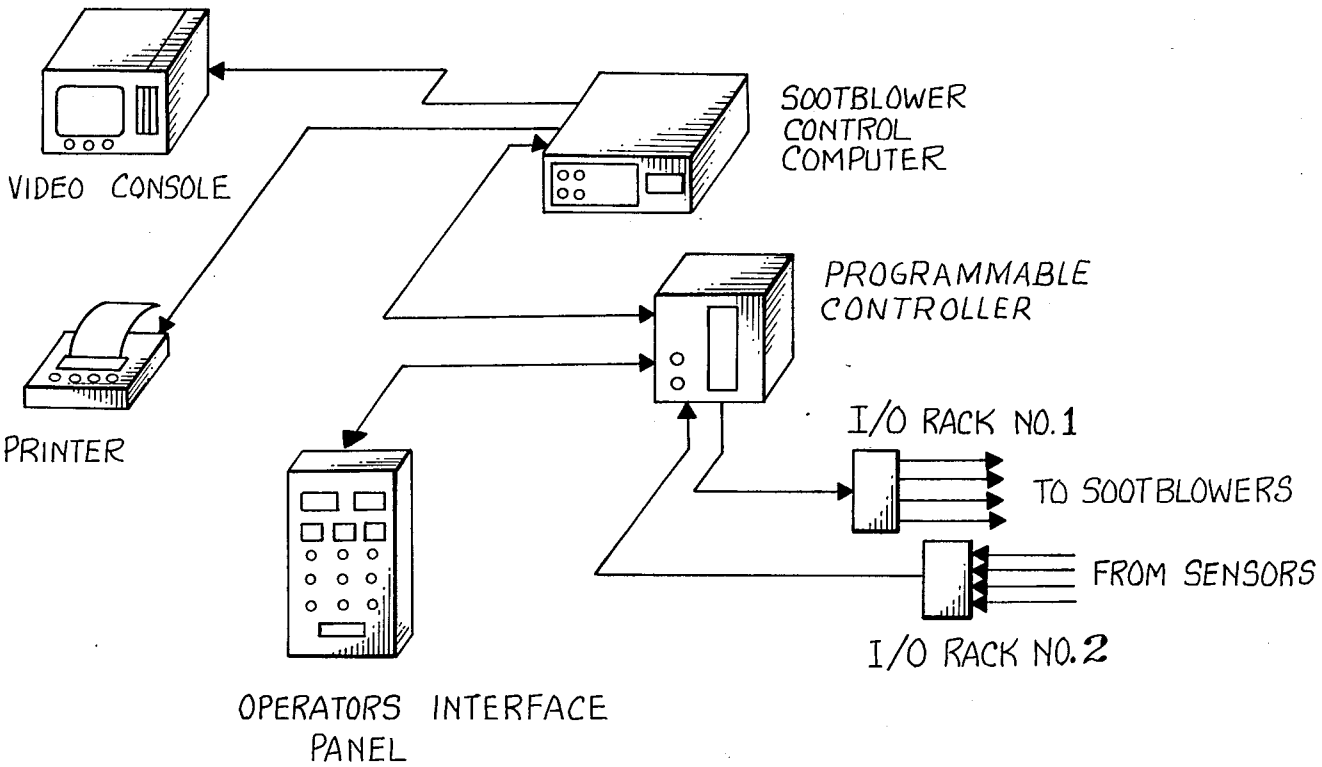
FIG. 1 is a block diagram showing the principal control equipment used in the present method.

FIG. 1 indicates the equipment used in the implementation of the present invention in addition to the usual boiler sootblowing equipment. This is a relatively standard combination of off-the-shelf items which does not form a part of the present invention. An operator's interface panel, a video console and a printer will normally be located at the operator's station. From the operator's interface panel, the operator can switch back and forth from computer mode to local mode. From the video console, he may change sootblowing parameters in response to his perception of the sootblowing performance.

Figure 2:
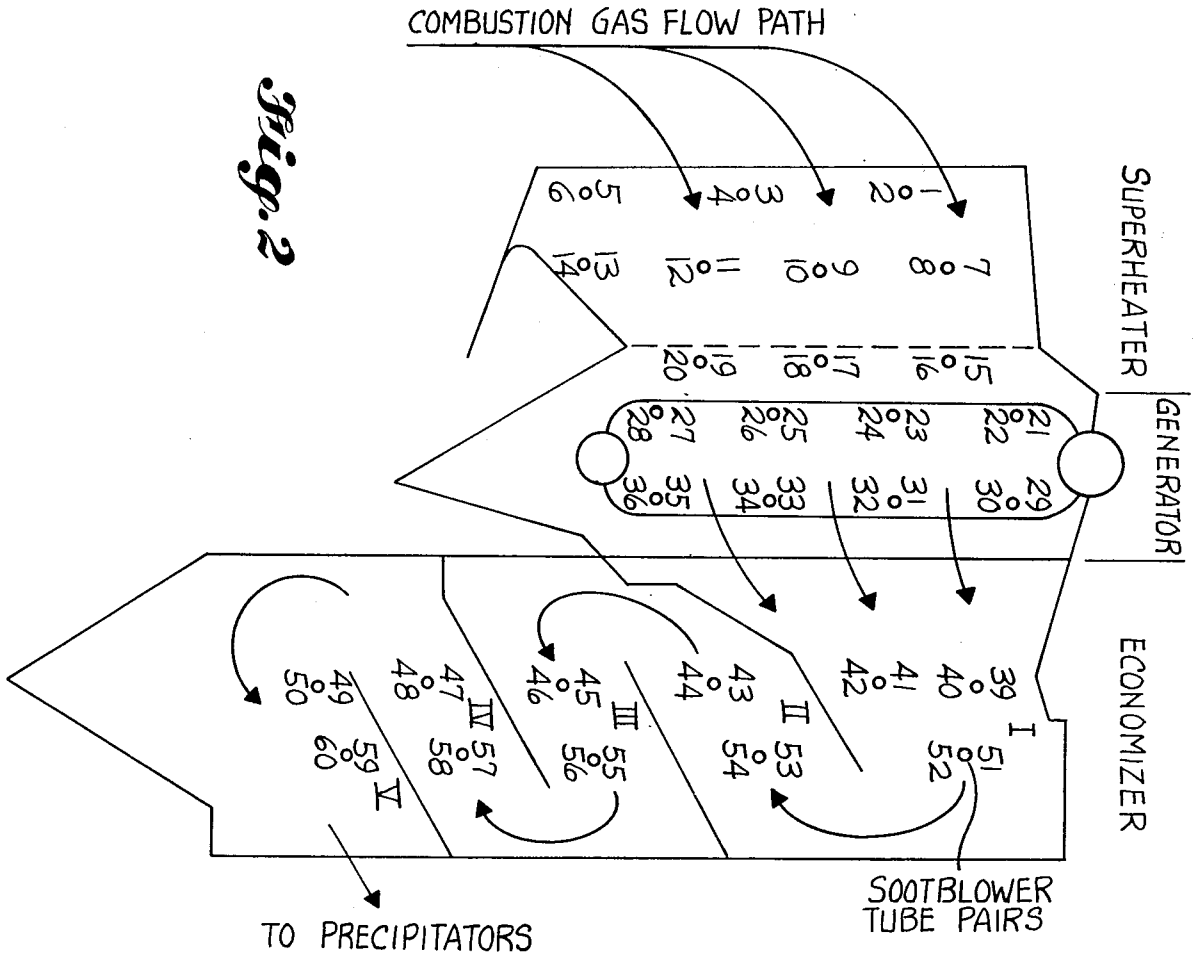
FIG. 2 is a simplified cross-sectional representation of a chemical recovery boiler showing the location of the sootblower pairs.

A sootblower diagram for a large kraft chemical recovery boiler is shown in FIG. 2 in generalized form. This boiler was designed with a capacity of 1630 t/day of black liquor solids. The sootblowers are divided into eight groups organized as shown in the following table.

TABLE I

| Group No. | Sootblower Groups Pair 1 | Pair 2 | Pair 3 | Pair 4 | Location |
|---|---|---|---|---|---|
| 1 | 1–2 | 3–4 | 5–6 | | Screen |
| 2 | 7–8 | 9–10 | 15–16 | 17–18 | Superheater |
| 3 | 11–12 | 13–14 | 19–20 | | Superheater |
| 4 | 21–22 | 29–30 | 23–24 | 31–32 | Generator |
| 5 | 25–26 | 33–34 | 27–28 | 35–36 | Generator |
| 6 | 39–52 | 51–40 | 41–42 | | Economizer I |
| 7 | 46–53 | 45–54 | 43–56 | 44–55 | Economizer II & III |
| 8 | 50–57 | 49–58 | 47–60 | 48–59 | Economizer IV |

Three criteria should be considered in assignment of sootblowers to groups. A group should include only that portion of the boiler which has similar specific deposit formation characteristics. In a typical kraft chemical recovery boiler, the following variations in deposits are commonly found.

1. Self-cleaning deposits at the furnace nose and lower superheating surfaces.
2. Severe slagging and fouling with perhaps smelt inclusions at the upper superheating surfaces and front of the generator.
3. Light dusting in the back of the generator and economizer.

As the second criterion, a group should include only sootblowers which cover a zone of the boiler which can be monitored with a given set of sensors.

Finally, sootblowers should be assigned within a group in such a manner that upstream sootblowers will be blown before downstream sootblowers. This latter rule prevails throughout the entire boiler; i.e., upstream groups are blown before downstream groups. In this manner the loosened deposits are swept out of the recovery boiler in the direction of the flue gas.

The sootblowing frequency of each sootblower can be controlled independently by assigning a weight factor between 10 and 100% to each pair of sootblowers. For purposes of the present description, this will be called the Default Weight Factor. The relationship between the weight factor and the blowing frequency of a pair of sootblowers may be summarized as follows.

| WT Factors | Blowing Frequency |
|---|---|
| 100 | Every cycle |
| 50 | Every other cycle |
| 25 | Every fourth cycle |
| 10 | Every tenth cycle |

This feature allows higher blowing frequency in zones of the recovery boiler where deposit formations are known to be more severe. Sootblowers in any given group may or may not have identical weight factors depending on how critical they are in keeping the zone clean.

The sootblowing frequency of the sootblowers within a group can be modified using sensor measurement inputs. The inputs are used to calculate a bias to be applied to the Default Weight Factor thus generating the Current Weight Factor of a sootblower pair. For each group up to four sensor measurements may be used to bias the Default Weight Factor. Two kinds of sensor measurements may be considered. The first includes measurements suited for a feedback-type of control scheme. The sootblowing control system uses these measurements to take corrective actions after the controlled variable (deposits) is affected. The following measurements may be included: gas pressure drops, exit flue gas temperatures, heat transfer coefficients, and flue gas temperature drops. The second group of sensor measurements are suited for a feed forward type of control scheme. Here the sootblowing control system uses these measurements to take corrective actions before the controlled variable (deposits) is affected. Among the sensor measurements which may be included are boiler load changes, as measured by feed water or fuel supply changes; sulfur dioxide or other chemical component changes in the exit flue gas, and the gas temperature entering the generator section of the boiler.

The duration of the sootblowing cycle is a function of the Weight Factors assigned to the sootblowers. Unless the Weight Factors of all the sootblowers is set to 100, only a fraction of the sootblowers are blown during a cycle. The average Weight Factor of all the sootblowers indicates the fraction of the sootblowers which are to be blown during the sootblowing cycle under nominal operating conditions.

SOOTBLOWING CONTROL STRATEGY

A hypothetical example will make it easier to understand the sootblowing strategy. It is presumed that the method is implemented on a small recovery boiler which has 12 pairs of sootblowers distributed and assigned within three groups as follows: 4 pairs in the superheater zone (Group 1), 4 pairs in the generator zone (Group 2), and 4 pairs in the economizer zone (Group 3). A Default Weight Factor is assigned to each pair of sootblowers in each group as shown in the following table. Certain terms found in this table have not been used to this point, but these will be explained in the discussion which immediately follows.

TABLE II

Sootblower Weight Factors

| Group 1 - Superheater | | | | | |
|---|---|---|---|---|---|
| Pairs | 1 | 2 | 3 | 4 | Σ |
| Default Weight Factor, $W_d$ | 40 | 30 | 50 | 40 | 160 |
| Group Bias, $B_g$ | 1.1 | 1.1 | 1.1 | 1.1 | |
| Current Weight Factor, $W_c$ | 44 | 33 | 55 | 44 | 176 |
| Accumulated Weight from Previous Blowing Cycle, W | 40 | 40 | 70 | 50 | |
| Accumulated Weight Factor, $W_a$ | 84 | 73 | 125 | 94 | 376 |
| **Group 2 - Generator** | | | | | |
| Pairs | 5 | 6 | 7 | 8 | Σ |
| Default Weight Factor | 50 | 100 | 60 | 20 | 230 |
| Group Bias | 1.1 | 1.1 | 1.1 | 1.1 | |
| Current Weight Factor | 55 | 110 | 66 | 22 | |
| Accumulated Weight from Previous Blowing Cycle | −10 | −10 | 20 | 70 | |
| Accumulated Weight Factor | 45 | 100 | 86 | 92 | 323 |
| **Group 3 - Economizer** | | | | | |
| Pairs | 9 | 10 | 11 | 12 | Σ |
| Default Weight Factor | 30 | 30 | 30 | 30 | 120 |
| Group Bias | 1.1 | 1.1 | 1.1 | 1.1 | |
| Current Weight Factor | 33 | 33 | 33 | 33 | |
| Accumulated Weight from Previous Blowing Cycle | 20 | 20 | −20 | −20 | |
| Accumulated Weight Factor | 53 | 53 | 13 | 13 | 132 |

The boiler performance, and by implication the sootblowing performance of each zone, is monitored by sensors located in several zones of the boiler. A set of typical parameters is given in Table III. The nominal parameters are those that would be expected from long operating experience, whereas the actual parameters are those being currently indicated by the instrumentation.

TABLE III

Nominal and Measured Operating Parameters

| | Nominal | Actual | Worst Case |
|---|---|---|---|
| **Superheater** | | | |
| Exit Flue Gas Temperature, °C. | 649 | 654 | 704 |
| Heat Transfer Coefficient, $W/m^2 \cdot K$ | 56.8 | 62.5 | 28.4 |
| Boiler Load, L/m | 1325 | 1362 | 1514 |
| **Generator Section** | | | |
| Inlet Flue Gas Temperature | 649 | 654 | |
| Heat Transfer Coefficient | 113.6 | 102.2 | |
| Boiler Load | 1325 | 1363 | |
| Generator Gas Side ΔT, °C. | 149 | 143 | |
| **Economizer Section** | | | |
| Gas Side Pressure Drop, mm of water | 102 | 76 | |
| Heat Transfer Coefficient | 22.7 | 19.9 | |
| $SO_2$ in Flue gas, ppm | 0 | 40 | |
| Boiler Load | 1325 | 1363 | |

CALCULATION OF GROUP BIAS

Before calculating the Group Bias of each group it is first necessary to calculate a Bias Coefficient for each variable being measured. The variables chosen for Group 1 (the superheater section) in Tables II and III will be used as an example.

$$K_{gi} = \frac{1}{WC_i - NM_i}$$

Where:

$K_{gi}$ is the bias coefficient for variable i $WC_i$ is the worst case value for variable i $NM_i$ is the nominal value for variable i The worst case value is the highest (or lowest) value of a variable that can normally be tolerated while the nominal value is that determined by experience when the system is operating at maximum efficiency. A nominal value equals a bias of 0 while a worst case value equals a bias of 1. For Group 1:

| Exit Gas Temp. | Heat Transfer Coeff. | Boiler Load |
|---|---|---|
| $K_{gt} = 1/(704 - 649) = 0.018$ | $K_{gU} = 1/(28.4 - 56.8) = 0.035$ | $K_{gb} = 1/(1514 - 1325) = 0.005$ |

The bias contribution of each variable assigned to the group is determined as follows:

$$B_i = K_{gi}(V_i - NM_i)$$

Where:

$B_i$ is the bias contribution of variable i $K_{gi}$ is the bias coefficient $V_i$ is the current actual value of variable i $NM_i$ is the nominal value The bias contribution is determined as follows:

| Exit Gas Temp. | Heat Transfer Coeff. | Boiler Load |
|---|---|---|
| $K_t = 0.18(654 - 649) = 0.1$ | $K_U = -0.035(62.5 - 56.8) = -0.2$ | $K_b = 0.005(1363 - 1325) = 0.2$ |

The bias of the entire group is found by summing the individual bias contributions and adding 1.

$$B_g = 1 + \Sigma(B)$$

Where:

$B_g$ is the group bias factor

In the present example:

$$B_g = 1 + (0.1 - 0.2 + 0.2) = 1.1$$

In actual practice it is convenient to have maximum and minimum values for group bias set into the system software. In the case of a calculated group bias greater than the programmed maximum bias, the system would default to the maximum value. An equivalent condition would prevail for a calculated group bias less than the programmed minimum value. This practice is a safeguard against a bad sensor in the boiler.

THE CURRENT WEIGHT FACTOR

Current Weight Factor $W_c$ is calculated by multiplying the Default Weight Factor of each individual sootblower in a group by the group bias (Table II).

THE ACCUMULATED WEIGHT FACTOR

Accumulated Weight Factor $W_a$ is an indicator of the total amount of fouling accumulated on the boiler tubes in the neighborhood of a given sootblower. When added to the Accumulated Weight W remaining after the previous blowing cycle it serves to indicate which and how many sootblowers in a group should be blown in the present cycle. In Table II the Accumulated Weight from the previous blowing cycle is a set of numbers chosen arbitrarily for purposes of this example. It will become clear as the example proceeds how Accumulated Weight is determined for succeeding sootblowing cycles.

The Accumulated Weight Factor for any sootblower (or pair of sootblowers) is calculated from the formula:

$$W_a = W_c + W$$

Where:

$W_a$ is the Accumulated Weight Factor

W is the Accumulated Weight from the previous cycle $W_c$ is the Current Weight Factor For the sootblowers of Group 1 the Accumulated Weight Factors are determined as follows:

| | | |
|---|---|---|
| Pair 1 | $W_a = 44 + 40 =$ | 84 |
| Pair 2 | $W_a = 33 + 40 =$ | 73 |
| Pair 3 | $W_a = 55 + 70 =$ | 125 |
| Pair 4 | $W_a = 44 + 50 =$ | 94 |
| | $\Sigma W_a$ | 376 |

As previously noted, the Default Weight Factor sets the percentage of times that a given sootblower pair is blown when averaged over a large number of sootblowing cycles. The Accumulated Weight Factor helps to determine when the sootblower pair should be blown. The formulas and exemplary calculations just given, and those to follow, form part of what might be titled a *Spreading Algorithm.* This algorithm regulates the blowing sequences to ensure that all sootblowers are blown according to their Default Weight Factors and that they are reasonably spaced. A sootblower with a default weight factor of 40 should be blown four times every 10 cycles. An undesirable spacing pattern might look as follows over 10 cycles, where "X" indicates that the sootblower was blown and "O" shows that it wasn't blown.

| Cycle | 1 | 2 | 3 | 4 | 5 | 6 | 7 | 8 | 9 | 10 |
|---|---|---|---|---|---|---|---|---|---|---|
| | O | X | X | O | O | O | O | O | X | X |

The spreading algorithm serves to space the blowing pattern so that it might appear as follows:

| Cycle | 1 | 2 | 3 | 4 | 5 | 6 | 7 | 8 | 9 | 10 |
|---|---|---|---|---|---|---|---|---|---|---|
| | O | X | O | X | O | O | X | O | X | O |

The spreading algorithm must also ensure good spreading in the number of blown sootblowers. For example, under stable operation, one wants to avoid blowing 12 sootblowers during one cycle and 20 during the next cycle.

The next step in using the spreading algorithm is to calculate the group accumulated weight by summing the Accumulated Weight Factors $W_a$ of each sootblower in a group. For Group 1 this value is 376. To determine the number of sootblowers N to be blown in the current cycle this value is divided by 100. If the result is not a whole number it is truncated to the next lower whole number. Thus, for Group 1:

$$N=376/100=3.76 \text{ or, in truncated form, } 3$$

The three sootblowers with the highest Accumulated Weight Factors; i.e., Nos. 1, 3 and 4 will be blown in the current cycle.

The spreading algorithm must also look forward to the following cycles. This is done by summing the accumulated weight for the current and next cycles. To do this, the current cycle Group Accumulated Weight Factors $\Sigma W_a$ is added to the sum of the Group Current Weight Factors $\Sigma W_c$.

$$W_s=\Sigma W_a+\Sigma W_c$$

Where:

$W_s$ is the summed accumulated weight for the current and next sootblowing cycles.

For Group 1

$$W_s=376+(44+33+55+44)=552$$

Again this value is divided by 100, and the dividend truncated, to obtain the number of sootblowers to be blown in the current and next cycles. Thus $$N=552/100=5.52 \text{ or, in truncated form, } 5$$

Knowing that three pairs are to be blown in the current cycle, it is evident that $5-3=2$ pairs are expected to be blown in the following cycle if steady state operation is maintained.

The reason for trying to anticipate the number of sootblowers blown in the following cycle is to make sure that under steady state there is no great discrepancy between the overall number of sootblowers blown during the current cycle and the anticipated overall number of sootblowers to be blown during the following cycle. This test for discrepancy is continuously performed as the sootblowing cycle progresses. If discrepancy is observed, then the system automatically adds or subtracts sootblowers to be blown in the current cycle.

Once a pair is blown the Accumulated Weight Factor $W_a$ of the sootblowers is "reset" by subtracting 100. This subtraction is not done for pairs that are not blown in the current cycle. The Accumulated Weights W to be carried to the next cycle are found to be as follows.

| Sootblower Pair | 1 | 2 | 3 | 4 |
|---|---|---|---|---|
| $W_a$, current cycle | 84 | 73 | 125 | 94 |
| Resetting factor | −100 | 0 | −100 | −100 |
| W, next cycle | −16 | 73 | 25 | −6 |

The Current Weight Factors $W_c$ are again added to the next cycle W values. For the calculation it is assumed that the boiler has been operating in stable condition and the Group Bias, thus the Current Weight Factors, are unchanged.

| Sootblower pair | 1 | 2 | 3 | 4 | Σ |
|---|---|---|---|---|---|
| W, Next cycle | −16 | 73 | 25 | 6 | |
| $W_c$ | 44 | 33 | 55 | 44 | |
| $W_a$ next cycle | 28 | 106 | 77 | 50 | 261 |

Since two pairs are to be blown, sootblowers pairs 2 and 3 are chosen for the next cycle because their Accumulated Weight Factors are the highest.

CYCLE TIME

Cycle time is the anticipated time, in minutes, to complete a full sootblowing sequence from its beginning at the upstream portion of the heat transfer surfaces through its conclusion at the final downstream portion. Cycle time is a compromise between several factors. Boiler tube cleanliness must be balanced between sootblowing steam availability and economically acceptable steam usage. Sootblowing steam can amount to about 3–12% of the total steam generated in a kraft recovery boiler. Obviously, it is highly desirable from an economic standpoint to minimize usage.

In the process of the present invention, sootblowing cycle time is a function of the average Weight Factors of all the sootblowers. This average indicates the fraction of the sootblowers that are to be blown in a given cycle. It is also a function of the steam target which is the percentage of available steam that an operator intends to use during a sootblowing cycle. A target of 100% is the amount of steam needed to blow all individual sootblower pairs simultaneously ("double blow") during a cycle. A target of 50% is the amount of steam necessary to blow the individual pairs sequentially ("single blow") during a sootblowing cycle. Steam Rate Target can be chosen by an operator based on experience, operational observations, and other empirical considerations. A Steam Rate Target below 50% indicates that there is time at the end of the cycle when no sootblowing occurs. From a steam usage standpoint, sequential blowing is to be preferred, at least in part, if this is possible. The logic of this procedure, which may not be immediately apparent, will be explained in the section which immediately follows.

Sootblowing Cycle Time $T_C$ is determined by the relationship;

$$T_C=T_s(\Sigma W_d)/SRT$$

Where:

$T_s$ is the time required for an individual sootblower (or a sootblower pair when they are operated simultaneously) to complete its cycle. This time usually varies between about 3–6 minutes.

$\Sigma W_d$ is the sum of the Default Weight Factors of all groups of sootblowers.

SRT is Steam Rate Target

It is evident that the same absolute amount of steam is used in a given cycle regardless of whether the sootblowers are single or double blown. However, it is also apparent that cycle time is halved by a double blowing sequence. In effect, this doubles overall sootblowing steam usage, assuming that one cycle immediately follows another. Thus, lengthening cycle time by selecting the lowest Steam Rate Target consistent with the desired level of boiler cleanliness is a major factor in reducing usage of sootblowing steam.

In actual practice, it is possible that some combination of single and double mode sootblowing will occur during a cycle. This is a result of choosing a Steam Rate Target between 50% and 100%. Determining the number of sootblowers to be blown in each mode at any point in a sootblowing cycle is carried out in a two-step algorithm.

$$N=\Sigma W_{RG}/100$$

Where

N is the number of remaining sootblowers to be blown $\Sigma W_{RG}$ is the sum of the Accumulated Weight Factors of the current and all remaining groups.

As the next step, the time $T_r$ to blow all sootblowers in single mode is estimated:

$$T_r=2NT_s$$

Required remaining time is then compared with the total cycle time. If it is greater than the time left in the sootblowing cycle, then the mode is set to double blow. Otherwise, it is set to single blow.

To illustrate this by means of an example, assume the following values apply to the groups of the earlier example of Tables II and III. Further assume that $T_s$ is 5 minutes and SRT is 60%. At the beginning of the first cycle the number of sootblowers anticipated to be blown throughout the cycle is:

$$N=(376+323+132)/100=8$$

Where 376, 323 and 132 are the values of the Group Accumulated Weight Factors (Table II).

Then, cycle time is:

$T_C=(5)(160+230+120)/60=42.5$ min or, rounded to the next higher 5 minutes, 45 min.

Next, the remaining time to single blow all sootblowers is determined.

$$T_r=(2)(8)(5)=80 \text{ minutes}$$

Because 80 minutes is greater than the 45-minute cycle time, the cycle will begin by double blowing the three sootblower pairs in Group 1.

Remaining cycle time is continuously updated by the control computer during the cycle. If for operational reasons, it is not desirable to operate sootblowers of a group simultaneously, it is possible to delay double blow of sootblowers to groups covering heat transfer surfaces where double blow has no adverse effect. In the example given, 5 pairs would be double blown and 2 pairs single blown.

The software for a system of the type just described will normally be configured to allow an operator override of biasing inputs. However, it is not desirable for blowing sequences to be scheduled less frequently than is called for by Default Weight Factors.

Figure 3:
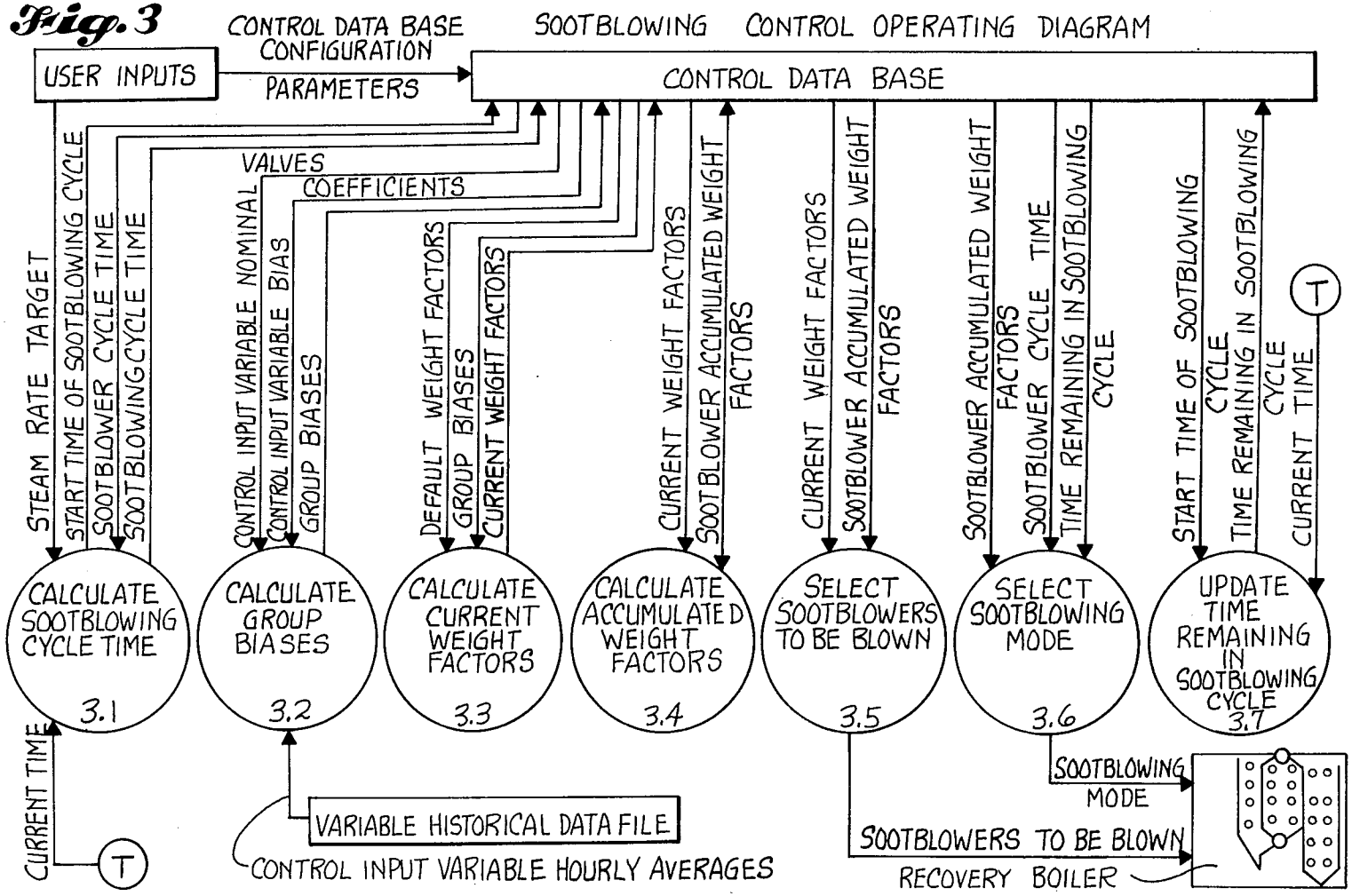
FIG. 3 is a diagram showing the overall control strategy of the sootblowing system.
Figure 4:
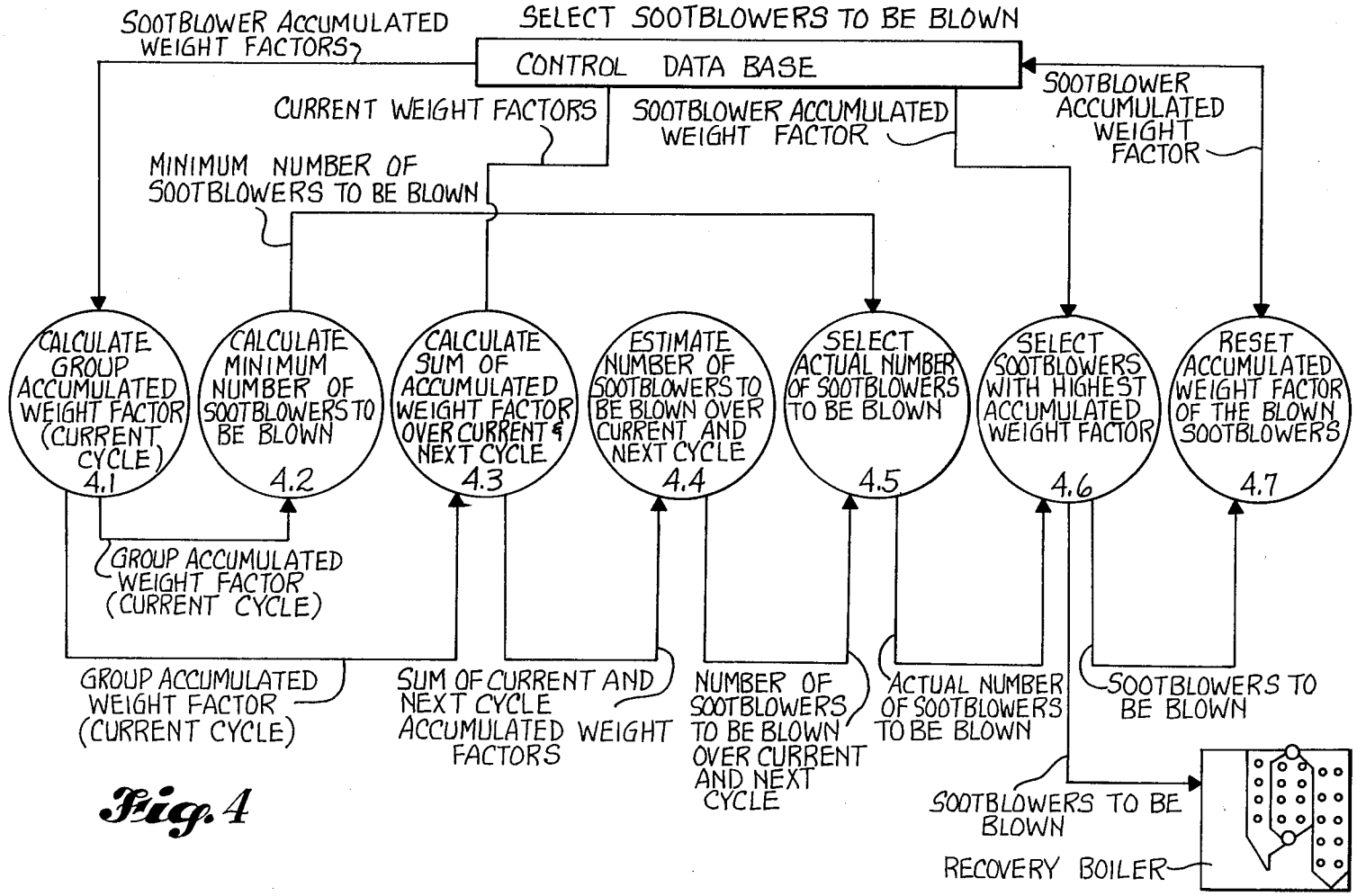
FIG. 4 is a subroutine of the sootblower control strategy outlining the logic which determines which sootblowers are to be blown during any given cycle.
Figure 5:
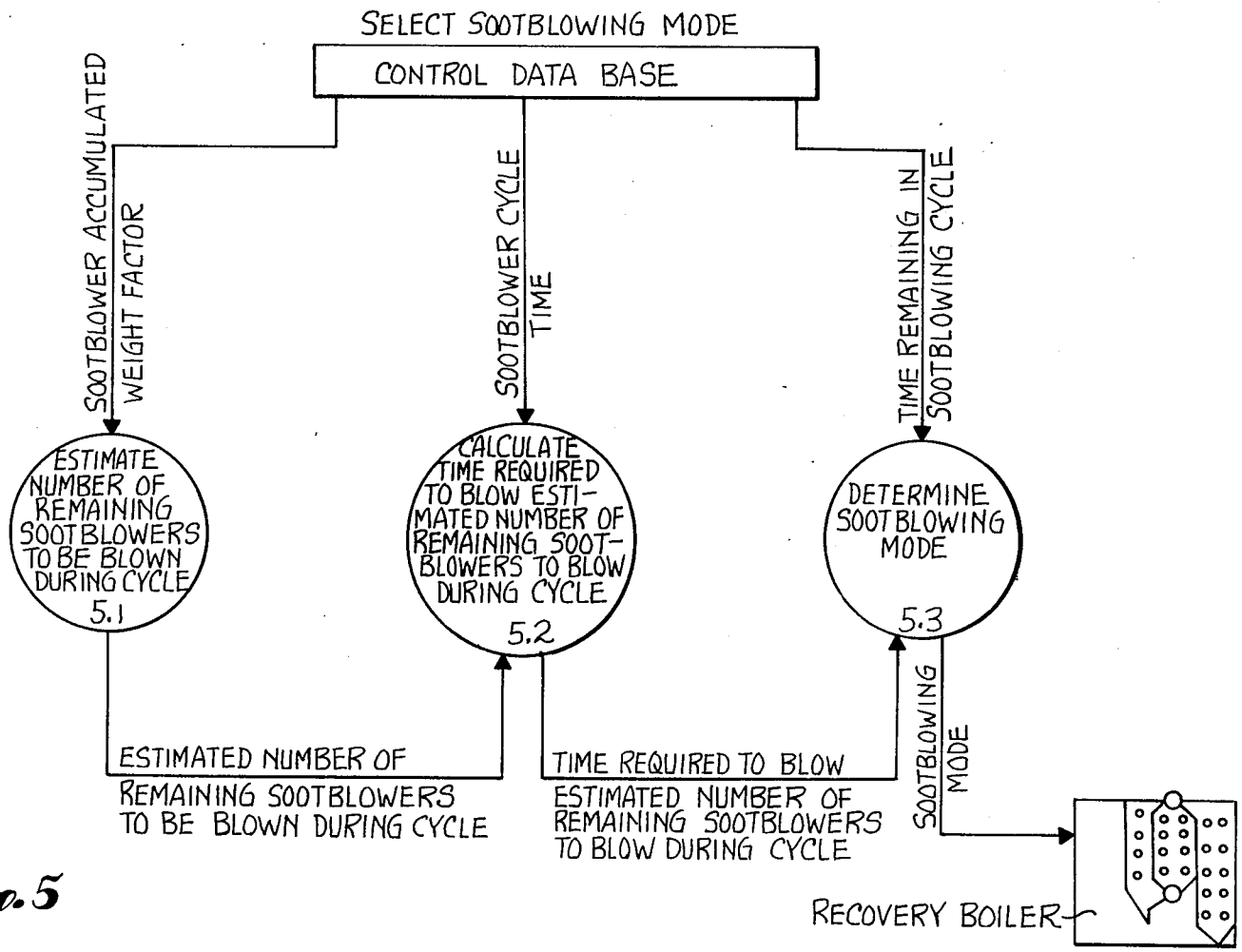
FIG. 5 outlines the control strategy used to determine whether sootblower pairs are blown sequentially or simultaneously within any given sootblowing cycle.

FIGS. 3–5 completely outline the software logic of the sootblowing control sequence. FIG. 4 is an amplification in some detail of the selection logic from circle 3.5 of FIG. 3 regarding the selection of sootblowers to be blown. FIG. 5 is a similar elaboration of the logic from circle 3.6 of FIG. 3 as to selection of sootblowing mode.

EXAMPLE OF TRIAL RUN OF METHOD

The sootblowing method just described was implemented on a large kraft recovery boiler having 29 sootblower pairs (FIG. 2). These were organized into 8 groups as follows:

TABLE IV

| Group No. | Sootblower Pair Assignment Pair 1 | Pair 2 | Pair 3 | Pair 4 |
|---|---|---|---|---|
| 1 | 1–2 | 3–4 | 5–6 | |
| 2 | 7–8 | 9–10 | 15–16 | 17–18 |
| 3 | 11–12 | 13–14 | 19–20 | |
| 4 | 21–22 | 29–30 | 23–24 | 31–32 |
| 5 | 25–26 | 33–34 | 27–28 | 35–36 |
| 6 | 39–52 | 51–40 | 41–42 | |
| 7 | 53–46 | 45–54 | 43–56 | 55–44 |
| 8 | 57–50 | 49–58 | 47–60 | 59–48 |

Groups 1 and 2 generally covered the superheater section, 3–5 the generator tube section, and 5–8 the economizer.

In 5 periods of 12–14 days each the following sootblowing steam usage was recorded. Daily averages were computed on samples taken at 5-minute intervals.

TABLE V

| Time Interval | Sootblowing Steam Usage: Total Steam Generated kg/hr × 1000 | Sootblowing Steam, kg/hr × 1000 | Sootblower Usage, % of Total Steam |
|---|---|---|---|
| 1 | 229 | 9.2 | 4.10 |
| 2 | 234 | 8.7 | 3.72 |
| 3 | 259 | 9.6 | 3.68 |
| 4 | 253 | 10.0 | 3.96 |
| 5 | 274 | 10.0 | 3.64 |
| Average | 250 | 9.5 | 3.69 |
| Control* | — | 14.5–15.9 | ~6 |

*Using a continuous sequence of single and double blowing in which every sootblower was blown every cycle. Sootblowing steam usage was independent of load and averaged 8–9% at low loads and 5–5.5% at high boiler loads. Cycle times averaged 3–4 hours.

Figure 6:
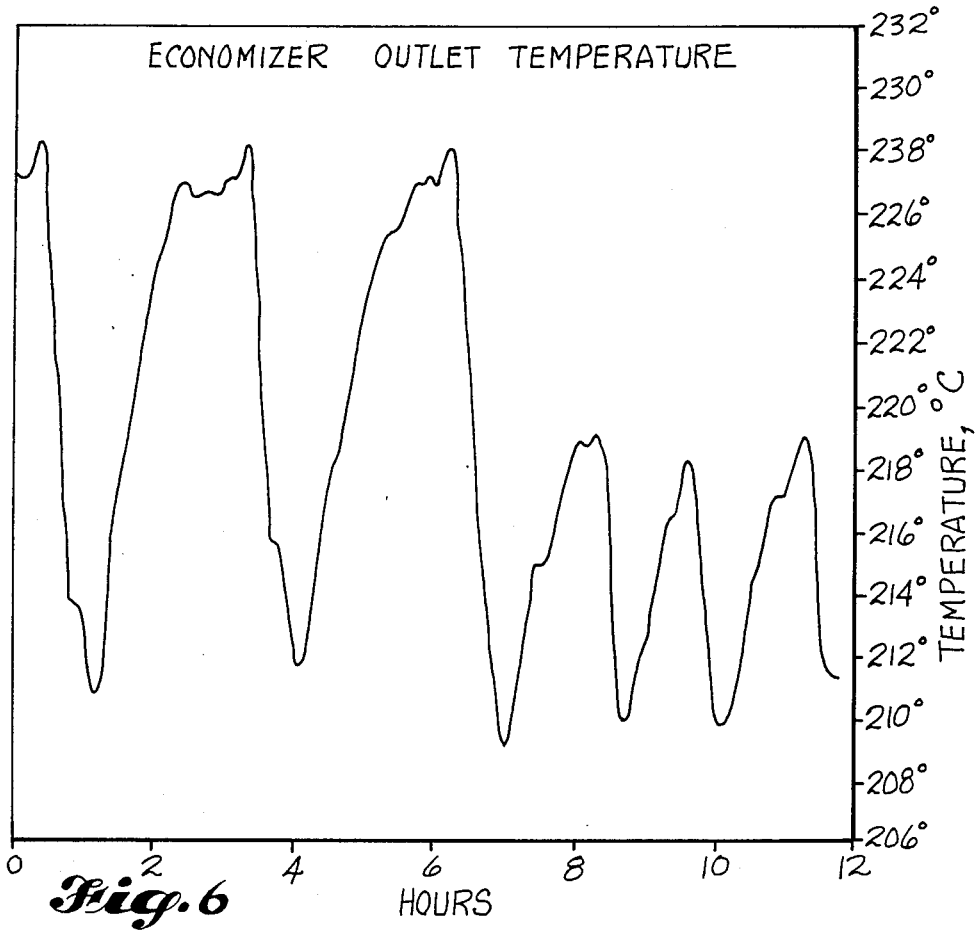
FIG. 6 shows the gas side temperature at the economizer outlet of a chemical recovery boiler using conventional sootblowing and the method of the present invention.

The gain in boiler efficiency was even more marked than was the appreciable reduction in sootblowing steam usage. It is known that a boiler will gain about 1% increase in efficiency for every 22° C. reduction in stack gas temperature. FIG. 6 shows gas temperatures at the economizer outlet for seven hours (2½ sootblowing cycles) of conventional operation and 5 hours (3 blowing cycles) of operation according to the present invention. Using the conventional sootblowing system, the temperature would swing between about 209° and 228° C., averaging about 221° C. With the method of the present invention temperature, swings fell to between about 210° and 219° C. with an average temperature of about 214° C. This represents a very significant efficiency improvement of over 0.3%.

Figure 7:
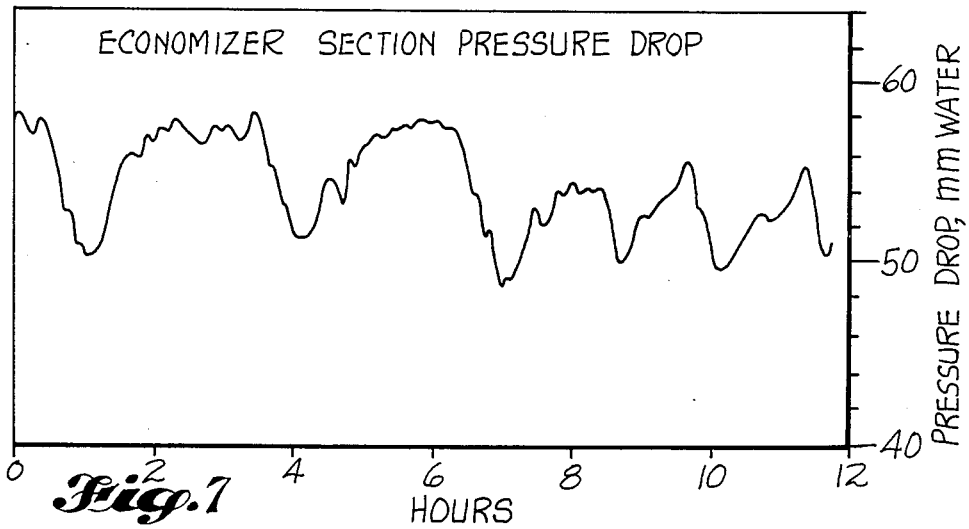
FIG. 7 is similar to FIG. 6 but shows gas side pressure drop across the economizer section.

A result similar to the above is seen in FIG. 7 which represents the gas side pressure drop across the economizer section of the boiler during the same time period of the tests of FIG. 6.

Another advantage of the present method when used with a kraft recovery boiler is not so readily apparent and stands in addition to boiler efficiency improvements. Ash swept from the tubes of a recovery boiler is predominately a mixture of sodium sulfate and sodium carbonate. As this ash is dislodged from the boiler tubes by the sootblowers, a considerable amount is collected by gravity in hoppers which underlie the various sections of boiler. The portion which is swept through the boiler by the flue gas is collected in an electrical precipitator before the gas is discharged to the stack. This ash must be returned to the incoming black liquor stream where it represents a circulating dead load on the boiler. It is not generally an acceptable procedure to direct it to the smelt dissolving tank and recausticizing system because of its high content of sodium sulfate. With conventional steamblowing procedures, the ash is usually returned in slugs at the end of each sootblowing cycle where it can be responsible for a major chemical unbalance in the black liquor stream to the boiler. This problem is greatly alleviated by using the present method with its overall generally much shorter cycle times.

Having thus disclosed the best mode presently known to the inventors of carrying out their new sootblowing method, it will be readily apparent to those skilled in the art that many changes could be made without departing from the spirit of the invention. The invention should be considered as limited only by the following appended claims.

We claim:

1. A method for controlling soot blowers in a boiler which comprises:

assigning the sootblowers into a plurality of groups, the sootblowers within a group being generally adjacent to each other and covering heat transfer surfaces having similar fouling deposit formation characteristics;

assigning a weight factor to each individual sootblower in every group, said weight factors determining the frequency of operation of each sootblower as a percentage of all sootblowing cycles so that not all of the sootblowers are blown every sootblowing cycle;

determining which sootblowers within a group are to be blown in any given sootblowing cycle using a spreading algorithm; and beginning every sootblowing cycle in the boiler with the most upstream sootblower group and proceeding progressively with sootblowing through all other groups in the direction of flow of combustion gases until reaching the most downstream sootblower group in order to sweep dislodged fouling deposits from the upstream heat transfer surfaces in the direction of flow of combustion gases, whereby the boiler is maintained at or near maximum efficiency with reduced sootblowing steam usage.

2. The method of claim 1 which further comprises:

providing instrumentation indicating heat transfer characteristics of at least some of the heat transfer surfaces associated with the sootblower groups;

noting any change in said heat transfer characteristics over time;

entering said change in heat transfer characteristics into a biasing algorithm to provide a heat transfer biasing factor; and modifying the sootblower weight factors with the heat transfer biasing factor to provide on-line compensation for real time deviations from an expected rate of heat transfer change.

3. The method of claim 1 which further comprises:

providing instrumentation indicating gas side pressure drop across at least some of the heat transfer surfaces associated with the sootblower groups;

noting any change in said pressure drop over time;

entering said change in pressure drop into a biasing algorithm to provide a pressure drop biasing factor; and modifying the sootblower weight factors with the pressure drop biasing factor to provide on-line compensation for real time deviations from an expected rate of pressure drop change.

4. The method of claim 1 which further comprises:

providing instrumentation indicating heat transfer characteristics of, and gas side pressure drop across, at least some of the heat transfer surfaces associated with the sootblower groups;

noting any change in said heat transfer characteristics and gas side pressure drop over time;

entering said change in heat transfer characteristics or pressure drop into a biasing algorithm to provide a combined heat transfer and pressure drop biasing factor; and modifying the sootblower weight factors with the combined biasing factor to provide on-line compensation for real time deviations from the expected rate of heat transfer or pressure drop change.

5. The method of claim 2 which further includes averaging the change in measured heat transfer characteristics over a period of at least half of a nominal sootblowing cycle before entering said change into the biasing algorithms.

6. The method of claim 3 which further includes averaging the change in measured pressure drop over a period of at least half of a nominal sootblowing cycle before entering said change into the biasing algorithms.

7. The method of claim 4 which further includes averaging the change in measured heat transfer characteristics and pressure drop over a period of at least half of a nominal sootblowing cycle before entering said change into the biasing algorithms.

8. The method of claim 2 which includes using the heat transfer information in a feedback-type control system.

9. The method of claim 3 which includes using the pressure drop information in a feedback-type control system.

10. The method of claim 4 which includes using the heat transfer and pressure drop information in a feedback-type control system.

11. The method of claim 1 which further comprises:

providing instrumentation generally relating to changes in boiler operating characteristics;

noting any change in said operating characteristics over time;

entering said change in operating characteristics into a biasing algorithm to provide an operating characteristic biasing factor; and using the operating condition biasing factor to modify the sootblower weight factors and provide on-line compensation for real time changes in boiler operation.

12. The method of claim 11 in which the information relating to boiler operating characteristics is used in a feed forward-type control system.

13. The method of claim 11 in which the information relating to boiler operating characteristics is combined with the information relating to heat transfer characteristics in a combined feedback and feed forward-type control system.

14. The method of claim 11 in which the information relating to boiler operating characteristics is combined with the information relating to pressure drop change in a combined feedback and feed forward-type control system.

15. The method of claim 11 in which the information relating to boiler operating characteristics is combined with the information relating to heat transfer characteristics and pressure drop change in a combined feedback and feed forward-type control system.

16. The method of claim 1 in which the spreading algorithm uses estimated present and next blowing cycle fouling load on the tubes within a sootblower group to determine which sootblowers are blown.

17. The method of claim 1 in which heat transfer changes in heat transfer surfaces associated with sootblower groups are used as an indicator of boiler tube fouling.

18. The method of claim 1 in which pressure drop changes across heat transfer surfaces associated with sootblower groups are used as an indicator of boiler tube fouling.

19. The method of claim 1 in which boiler operating characteristics are used as an estimator of boiler tube fouling.

20. The method of claim 1 in which the sootblowing cycle time is determined by selecting a sootblowing steam rate usage between 10 and 100% of available steam and entering said steam rate usage into a cycle time algorithm along with the unbiased sootblower weight factor.

21. The method of claim 20 in which the steam rate usage is selected within the limits of 40% to 100% of available sootblowing steam.

22. The method of claim 20 in which the steam rate usage selected determines whether sootblower pairs are blown simultaneously or sequentially during a sootblowing cycle.

* * * * *